US010977970B2

(12) United States Patent
Zhang et al.

(10) Patent No.: US 10,977,970 B2
(45) Date of Patent: Apr. 13, 2021

(54) ARRAY SUBSTRATE, DISPLAY APPARATUS, DETECTING APPARATUS AND DETECTING METHOD FOR DETECTING DEFECT CONNECTION OF DATA LINE

(71) Applicants: BOE Technology Group Co., Ltd., Beijing (CN); Ordos Yuansheng Optoelectronics Co., Ltd., Inner Mongolia (CN)

(72) Inventors: Wei Zhang, Beijing (CN); Yezhou Fang, Beijing (CN); Le Sun, Beijing (CN); Wenlong Zhang, Beijing (CN); Guangshuai Wang, Beijing (CN)

(73) Assignees: BOE TECHNOLOGY GROUP CO., LTD., Beijing (CN); ORDOS YUANSHENG OPTOELECTRONICS CO., LTD., Inner Mongolia (CN)

( * ) Notice: Subject to any disclaimer, the term of this patent is extended or adjusted under 35 U.S.C. 154(b) by 0 days.

(21) Appl. No.: 16/170,279

(22) Filed: Oct. 25, 2018

(65) Prior Publication Data

US 2019/0130804 A1 May 2, 2019

(30) Foreign Application Priority Data

Oct. 31, 2017 (CN) ..... 201711049384.6

(51) Int. Cl.
*G09G 3/00* (2006.01)
*G09G 3/20* (2006.01)
(Continued)

(52) U.S. Cl.
CPC ..... *G09G 3/006* (2013.01); *G09G 3/2003* (2013.01); *G09G 3/3225* (2013.01);
(Continued)

(58) Field of Classification Search
CPC ..... G09G 3/006; G09G 2330/12; G09G 2300/08; G09G 3/2003; G09G 3/3225;
(Continued)

(56) References Cited

U.S. PATENT DOCUMENTS 5,309,108 A * 5/1994 Maeda ..... G06T 7/001 324/501
6,265,889 B1 * 7/2001 Tomita ..... G09G 3/006 324/760.02

(Continued)

FOREIGN PATENT DOCUMENTS

| | | |
|---|---|---|
| CN | 103839503 A | 6/2014 |
| CN | 105954906 A | 9/2016 |
| JP | 10143114 | 5/1998 |

OTHER PUBLICATIONS

First Office Action dated Nov. 19, 2019 corresponding to Chinese application No. 201711049384.6.

*Primary Examiner* — Temesghen Ghebretinsae
*Assistant Examiner* — Karin Kiyabu
(74) *Attorney, Agent, or Firm* — Nath, Goldberg & Meyer; Joshua B. Goldberg

(57) ABSTRACT

The disclosure provides an array substrate, a display device, a detecting apparatus and a detecting method for detecting a defect connection of a data line. A data signal input bus of the array substrate of the present disclosure applies a data signal to each pixel unit, and a detection line is added on one side of the array substrate opposite to the data signal input bus, when the product is detected, the data signal input bus inputs the normal data signal, the detection line on the other side inputs a signal having a polarity contrary to that of the data signal. At a position of the data line existing defect connection, heat is generated and the data line is burnt at the position existing defect connection.

15 Claims, 3 Drawing Sheets

(51) Int. Cl.
*G09G 3/3225* (2016.01)
*G09G 3/36* (2006.01)

(52) U.S. Cl.
CPC ... *G09G 3/3648* (2013.01); *G09G 2300/0426* (2013.01); *G09G 2300/08* (2013.01); *G09G 2310/0297* (2013.01); *G09G 2330/12* (2013.01)

(58) Field of Classification Search
CPC ..... G09G 3/3648; G09G 2300/0426; G09G 2310/0297; G02F 2001/136254; G02F 1/1362; G02F 1/136286
See application file for complete search history.

(56) References Cited

U.S. PATENT DOCUMENTS

| | | | | |
|---|---|---|---|---|
| 6,624,857 | B1 * | 9/2003 | Nagata | G02F 1/1309 349/139 |
| 9,810,932 | B2 * | 11/2017 | Xu | G09G 3/36 |
| 10,102,783 | B2 * | 10/2018 | Huang | G09G 3/006 |
| 2006/0284646 | A1 * | 12/2006 | Shimizume | G09G 3/006 324/760.02 |
| 2009/0206334 | A1 * | 8/2009 | Yoon | G09G 3/006 257/48 |
| 2012/0140157 | A1 * | 6/2012 | Nishiwaki | G02F 1/133711 349/123 |
| 2012/0162165 | A1 * | 6/2012 | Lee | G09G 3/006 345/206 |
| 2013/0141314 | A1 * | 6/2013 | Ka | G09G 3/006 345/55 |
| 2017/0213490 | A1 * | 7/2017 | Jeong | G09G 3/006 |

* cited by examiner

ARRAY SUBSTRATE, DISPLAY APPARATUS, DETECTING APPARATUS AND DETECTING METHOD FOR DETECTING DEFECT CONNECTION OF DATA LINE

CROSS-REFERENCE TO RELATED APPLICATION

The present application claims priority to Chinese Patent Application No. 201711049384.6, filed on Oct. 31, 2017, the disclosure of which is hereby incorporated by reference.

TECHNICAL FIELD

The present disclosure relates to the field of display technology, and in particular, to an array substrate, a display apparatus, and a detecting apparatus and a detecting method for detecting a defect connection of a data line.

BACKGROUND

A display panel is manufactured through an Array process, a Cell process, and a Module process. Among these processes, the Array process generally includes manufacturing of gate lines and data lines, manufacturing of thin film transistors, manufacturing of pixel electrodes, and the like. The display panel includes a plurality of rows of gate lines and a plurality of columns of data lines, and the plurality of rows of gate lines and the plurality of columns of data lines define a plurality of pixels.

SUMMARY

An embodiment of the present disclosure provides an array substrate including: a plurality of gate lines; a plurality of data lines intersected with the plurality of gate lines; and a plurality of pixel units defined by the gate lines and the data lines; a data signal input bus connected to one end of each of the plurality of data lines; and a detection line connected to the other end of each of the plurality of data lines.

In some implementations, the data signal input bus is disposed at one side of the plurality of pixel units, and the detection line is disposed at another side of the plurality of pixel units opposite to the data signal input bus.

In some implementations, at least one first switching device is disposed between the data signal input bus and the plurality of data lines for controlling connection and disconnection between the data signal input bus and the plurality of data lines.

In some implementations, at least one second switching device is disposed between the detection line and the plurality of data lines for controlling connection and disconnection between the detection line and the plurality of data lines.

In some implementations, a polarity of a signal transmitted through the data signal input bus is contrary to that of a signal transmitted through the detection line.

In some implementations, the plurality of pixel units include even-numbered columns of pixel units and odd-numbered columns of pixel units, and the data signal input bus includes a first data signal input bus and a second data signal input bus, the first data signal input bus is connected to data lines for the even-numbered columns of pixel units, and the second data signal input bus is connected to data lines for the odd-numbered columns of pixel units.

In some implementations, the plurality of pixel units include even-numbered columns of pixel units and odd-numbered columns of pixel units, and the detection line includes a first detection line and a second detection line, the first detection line is connected to data lines for the even-numbered columns of pixel units, the second detection line is connected to data lines for the odd-numbered columns of pixel units.

In some implementations, the first switching device includes at least one third switch and at least one fourth switch, the third switch is configured for controlling connection and disconnection between the second data signal input bus and the data lines for the odd-numbered columns of pixel units, and the fourth switch is configured for controlling connection and disconnection between the first data signal input bus and the data lines for the even-numbered columns of pixel units.

In some implementations, the second switching device includes at least one fifth switch and at least one sixth switch, the fifth switch is configured for controlling connection and disconnection between the second detection line and the data lines for the odd-numbered columns of pixel units; the sixth switch is configured for controlling connection and disconnection between the first detection line and the data lines for the even-numbered columns of pixel units.

In some implementations, the data lines for the even-numbered columns of pixel units are respectively connected to the third switch and the fifth switch, and the data lines for the odd-numbered columns of pixel units are respectively connected to the fourth switch and the sixth switch.

In some implementations, the third switch and the fifth switch are simultaneously turned on or off.

In some implementations, the fourth switch and the sixth switch are simultaneously turned on or off.

An embodiment of the present disclosure provides a method for detecting defect connection of a data line of the array substrate as above, including steps of: applying a data signal to the plurality of data lines through the data signal input bus; applying a detection signal to the plurality of data lines through the detection line; and detecting whether the plurality of pixel units are lit to determine whether a defect connection exists in the plurality of data lines.

In some implementations, the detection signal and the data signal are voltage signals ranging from 5V to 10V.

In some implementations, the data signal and the detection signal are applied simultaneously.

In some implementations, a polarity of the detection signal is contrary to that of the data signal.

An embodiment of the present disclosure provides a detecting apparatus for detecting defect connection of a data line of the array substrate as above, including: a data signal applying device configured to apply a data signal to the plurality of data lines through the data signal input bus; a detection signal applying device configured to apply a detection signal to the plurality of data lines through the detection line; and a brightness detecting device configured to detect whether the plurality of pixel units are lit to determine whether a defect connection exists in the plurality of data lines.

An embodiment of the present disclosure provides a display device including above array substrate.

DETAILED DESCRIPTION

In order to make a person skilled in the art better understand solutions of the present disclosure, the present disclosure will be further described in detail below in conjunction with the accompanying drawings and specific embodiments.

Figure 1:
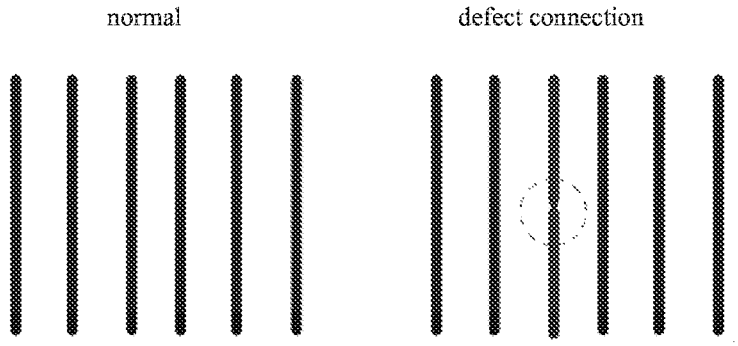
FIG. 1 is a schematic diagram illustrating a normal connection of a data line and an abnormal connection of a data line.

FIG. 1 is a schematic diagram illustrating a normal connection of a data line and an abnormal connection (defect connection) of a data line. In the Array process for manufacturing a display panel, due to reasons such as process defects, operational errors and process precision, as shown in FIG. 1, an abnormal connection (defect connection of a data line, e.g., the data line appears to be connected normally, but is poorly connected) may occur during the manufacturing process. The defect connection may enable the pixel to illuminate during the detection process, but result in fault in the data line in subsequent processes. In other words, some defect connections of the data lines are not easily to be found, and products with such defect connections are often not effectively intercepted during the manufacturing process, which affects product quality.

Embodiments of the array substrate according to the present disclosure will be described in detail below with reference to the accompanying drawings.

Figure 2:
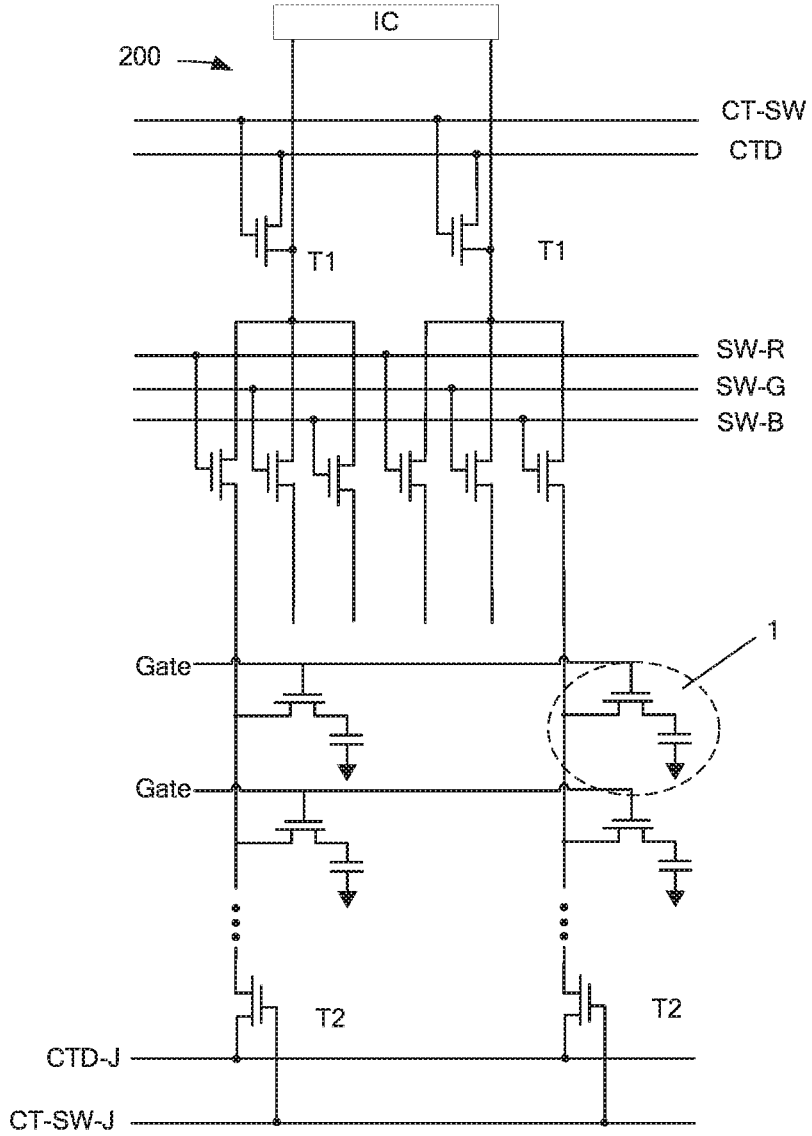
FIG. 2 is a schematic diagram illustrating a circuit structure of an array substrate according to an embodiment of the present disclosure.

FIG. 2 is a schematic diagram illustrating a circuit structure of an array substrate 200 according to an embodiment of the present disclosure. As shown in FIG. 2, the array substrate 200 includes: a plurality of gate lines Gate, a plurality of data lines, and a plurality of pixel units 1 defined by the gate lines Gate and the data lines which are intersected with each other, each data line intersected with the gate lines Gate is connected to multiple pixel units of the plurality of pixel units, and FIG. 2 only schematically shows that each data line is connected to two pixel units. The array substrate 200 further includes a data signal input bus CTD connected to one end of each of the plurality of data lines and a corresponding first switching signal line CT-SW, and a detection line CTD-J connected to the other end of each of the plurality of data lines for transmitting a detection signal and a corresponding second switching signal line CT-SW-J. A polarity of the detection signal is contrary to that of the data signal (also referred to as a lighting signal) transmitted by the data signal input bus CTD.

As shown in FIG. 2, in the array substrate of the present embodiment, the data signal input bus CTD transmits data signals to the data lines corresponding to the respective pixel units 1. A detection line CTD-J is added on a side of the array substrate opposite to the data signal input bus CTD, when the product is detected, the data signal input bus CTD transmits a normal data signal, and the detection line CTD-J on the other side transmits a signal, the polarity of which is contrary to that of the data signal, simultaneously, so that heat will be generated at a position where the data line is in a defect connection, and the data line will burnt at this position, therefore all the data lines can be quickly detected and a data line with defect connection can be accurately determined, the detection process is simple and convenient.

In the embodiment shown in FIG. 2, the data signal input bus CTD is reserved as a connection line between the data lines and a driving circuit in an area of the array substrate corresponding to a rim area of a display panel. The driving circuit can provide a data signal to the data lines corresponding to the pixel units through the data signal input bus. Similarly, a detection line CTD-J is disposed at a side of the array substrate opposite to the data signal input bus in the area of the array substrate corresponding to the rim area of the display panel, and the detection line is connected to the data lines to transmit a detection signal to the data lines corresponding to the pixel units.

In an embodiment of the present disclosure, as shown in FIG. 2, at least one first switching device T1 is disposed between the data signal input bus CTD and the plurality of data lines for controlling connection and disconnection between the data signal input bus and the plurality of data lines. Specifically, in an embodiment, as shown in FIG. 2, the first switching device T1 is a transistor, a control electrode of the first switching device T1 is connected to the switching signal line CT-SW, a first electrode of the first switching device T1 is connected to the data signal input bus CTD, and a second electrode of the first switching device T1 is connected to the data lines of the pixel units 1.

In an embodiment of the present disclosure, as shown in FIG. 2, for each first switching device T1, at least one second switching device T2 is provided between the detection line and the data lines for controlling connection and disconnection between the detection line and the data lines. Specifically, in an embodiment, as shown in FIG. 2, the second switching device T2 is a transistor, a control electrode of the second switching device T2 is connected to the second switching signal line CT-SW-J, and a first electrode of the second switching device T2 is connected to the detection line CTD-J, the second electrode of the second switching device T2 is connected to the data lines for the pixel units 1. When detecting the defect connection of the data lines, the first switching device T1 and the corresponding second switching device T2 are simultaneously turned on or off to ensure that the data signal input bus CTD and the detection line CTD-J simultaneously transmit signals to the data lines.

In an embodiment of the present disclosure, as shown in FIG. 2, switching signal control lines SW-R, SW-G and SW-B for sub-pixels are further provided between the data lines and the data signal input bus CTD, a sub-pixel on each of the data lines connected to the switching signal control lines is a red sub-pixel, a green sub-pixel or a blue sub-pixel, where SW-R indicates the switching signal control line for the red sub-pixel, SW-G indicates the switching signal control line for the green sub-pixel, and SW-B indicates the switching signal control line for the blue sub-pixel. At least one first switching device T1 is connected between the data signal input bus CTD and the switching signal control lines of the sub-pixels, as shown in FIG. 2. All of the red, green, and blue sub-pixels on three data lines corresponding to the single first switching device T1 are taken as a group of pixel units. FIG. 2 shows that all the pixel units 1 on a data line connected to the switching signal control line SW-B in a group of pixel units are blue sub-pixels, and the other end of the data line corresponding to the switching signal control line SW-B is connected to the second switching device T2. For the sake of simplicity, FIG. 2 does not show all the pixel units on a data line connected to the switching signal control line SW-R and all the pixel units on a data line connected to the switching signal control line SW-G in the group of pixel units. FIG. 2 shows that all the pixel units 1 on a data line connected to the switching signal control line SW-R are red sub-pixels and the other end of the data line corresponding to the switching signal control line SW-R is connected to the second switching device T2 in an adjacent group of pixel units. For the sake of simplicity, FIG. 2 does not show all the pixel units on a data line connected to the switching signal control line SW-B and all the pixel units on a data line connected to the SW-G in the adjacent group of pixel units. Switches are also provided between the data lines and the switching signal control lines SW-R, SW-G and SW-B, and the switches may be thin film transistors.

The detection line is disposed on the other side of the pixel unit 1 opposite to the data signal input bus, as shown in FIG. 2.

The data signal input bus is disposed at an upper edge of the array substrate, and the detection line is disposed at a lower edge of the array substrate, as shown in FIG. 2. It can be understood that it is also possible to provide the data signal input bus at the lower edge of the array substrate, and provide the detection line at the upper edge of the array substrate. According to actual requirements, for example, in practical applications, it is generally required to provide different data signals for data lines corresponding to adjacent groups of pixel units, so as to avoid flickering of pixel unit during detecting defect connection, thereby facilitating detection. Two data signals provided for the data lines corresponding to the adjacent groups of pixel units may be different in magnitude or different in polarity. In this case, the data signal input bus CTD may include a first data signal input bus for even-numbered columns of pixel units and a second data signal input bus for odd-numbered columns of pixel units to provide different data signals for the data lines corresponding to the adjacent groups of pixel units, and the detection line CTD-J includes a first detection line for the even-numbered columns of pixel units and a second detection line for the odd-numbered columns of pixel units for providing respective detection signals.

Therefore, another embodiment of the array substrate according to the present disclosure will be described in detail with reference to FIG. 3.

Figure 3:
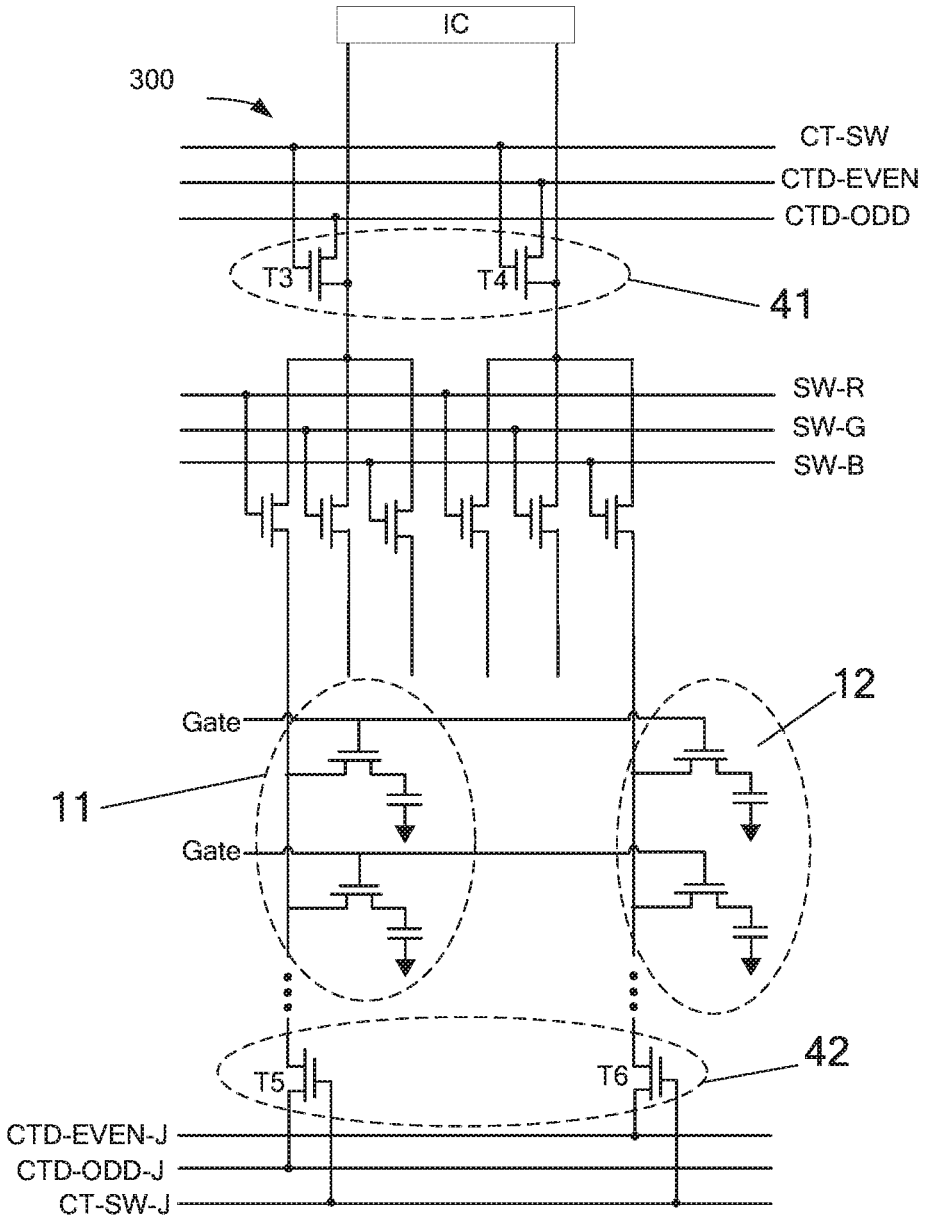
FIG. 3 is a schematic diagram illustrating a circuit structure of an array substrate according to another embodiment of the present disclosure.

FIG. 3 is a schematic diagram illustrating a circuit structure of an array substrate 300 according to another embodiment of the present disclosure. As shown in FIG. 3, the array substrate 300 includes: a plurality of gate lines Gate, a plurality of data lines, and pixel units 11 and 12 defined by the gate lines Gate and the data lines which are intersected with other, each of the data lines intersecting with the plurality of gate lines is connected to multiple pixel units of the plurality of pixel units, and FIG. 3 only schematically shows that each data line is connected to two pixel units. The array substrate 300 further includes two data signal input buses CTD-EVEN (a first data signal input bus for even-numbered columns of pixel units), CTD-ODD (a second data signal input bus for odd-numbered columns of pixel units) respectively connected to one end of each of the data lines and a corresponding first switching signal line CT-SW, and two detection lines CTD-EVEN-J (also referred as a first detection line for even-numbered columns of pixel units), CTD-ODD-J (also referred as a second detection line for odd-numbered columns of pixel units) respectively connected to the other end of each of the data lines for transmitting detection signals and a corresponding second switching signal line CT-SW-J. The first detection line CTD-EVEN-J for the even-numbered columns of pixel units transmits a detection signal, a polarity of which is contrary to that of a data signal transmitted by the first data signal input bus CTD-EVEN; the second detection line CTD-ODD-J transmits the detection signal, a polarity of which is contrary to that of a data signal transmitted by the second data signal input bus CTD-ODD. In an embodiment of the present disclosure, according to practical requirements, the data signals transmitted by the first data signal input bus CTD-EVEN and the second data signal input bus CTD-ODD may be the same or different.

Accordingly, the detection signals transmitted by the first detection line CTD-EVEN-J and the second detection line CTD-ODD-J may be the same or different, and respectively correspond to the data signals transmitted by the first data signal input bus CTD-EVEN and the second data signal input bus CTD-ODD. This embodiment is identical to the embodiment described with reference to FIG. 1 in a case where the first data signal input bus and the second data signal input bus transmit data signals the same with each other and the first detection line and the second detection line transmit detection signals the same with each other.

As shown in FIG. 3, the first data signal input bus CTD-EVEN and the second data signal input bus CTD-ODD respectively transmit different data signals to the data lines corresponding to pixel units 12 and 11. A detection line CTD-EVEN-J is added on a side of the array substrate opposite to the data signal input bus CTD-EVEN, a detection line CTD-ODD-J is added on a side of the array substrate opposite to the data signal input bus CTD-ODD, when the product is detected, the data signal input buses transmit normal data signals, and the detection lines on the other side transmit signals, the polarities of which are contrary to those of the data signals, simultaneously, so that heat will be generated at a position where defect connection exists in the data line, and the data line will burnt at this position, therefore all the data lines can be quickly detected and a data line with defect connection can be accurately determined, the detection process is simple and convenient.

The data signal input buses CTD-EVEN and CTD-ODD are reserved as connection lines between the data lines and the driving circuit in the area of the array substrate corresponding to the rim area of the display panel. The data lines for the odd-numbered columns of pixel units are connected to the data signal input bus CTD-ODD. The data lines for the even-numbered columns of pixel units are connected to the data signal input bus CTD-EVEN. The driving circuit may separately apply data signals to the data lines corresponding to the pixel units 11 and 12 through each of the data signal input buses. Similarly, two detection lines are disposed at a side of the array substrate opposite to the data signal input buses in the area of the array substrate corresponding to the rim area of the display panel, and the second detection line CTD-ODD-J is connected to the data line for the odd-numbered column of pixel units to transmit a detection signal to the data line corresponding to the pixel units 11, and the first detection line CTD-EVEN-J is connected to the data line for the even-numbered column of pixel units to transmit a detection signal to the data line corresponding to the pixel units 12.

The data line corresponding to the pixel units 11 is applied with a data signal via the second data signal input bus CTD-ODD, and the data line corresponding to the pixel units 12 is applied with a data signal via the first data signal input bus CTD-EVEN. At the same time, a detection signal is applied to the data line corresponding to the pixel units 11 via the second detection line CTD-ODD-J, and a detection signal is applied to the data line corresponding to the pixel units 12 via the first detection line CTD-EVEN-J, and it is ensured that the detection signal and data signal input into the data line corresponding to the pixel units 11 have contrary polarities, and the detection signal and data signal input into the data line corresponding to the pixel units 12 have contrary polarities.

In an embodiment of the present disclosure, as shown in FIG. 3, a first switching device 41 is disposed between the data signal input buses and the plurality of data lines for controlling connection and disconnection between the data signal input buses and the data lines. Specifically, the first switching device 41 includes a third switch T3 and a fourth switch T4, and the third switch is disposed between the second data signal input bus CTD-ODD and the data lines for the odd-numbered columns of pixel units, for controlling connection and disconnection between the second data signal input bus CTD-ODD and the data lines for the odd-numbered columns of pixel units. The fourth switch is disposed between the first data signal input bus CTD-EVEN and the data lines for the even-numbered columns of pixel units, for controlling connection and disconnection between the first data signal input bus CTD-EVEN and the data lines for the even-numbered columns of pixel units.

Specifically, in an embodiment, as shown in FIG. 3, the third switch T3 and the fourth switch T4 are transistors, wherein a control electrode of the third switch T3 is connected to the first switching signal line CT-SW, a first electrode of the third switch T3 is connected to the second data signal input bus CTD-ODD, and a second electrode of the third switch T3 is connected to the data line for the pixel units 11. A control electrode of the fourth switch T4 is connected to the first switching signal line CT-SW, a first electrode of the fourth switch T4 is connected to the first data signal input bus CTD-EVEN, and a second electrode of the fourth switch T4 is connected to the data line for the pixel units 12.

In an embodiment of the present disclosure, a second switching device 42 is disposed between the detection line and the plurality of data lines for controlling connection and disconnection between the detection line and the plurality of data lines.

In one embodiment of the present disclosure, as shown in FIG. 2, the second switching device 42 includes a fifth switch T5 and a sixth switch T6. For the third switch T3, the fifth switch is provided between the second detection line CTD-ODD-J and the corresponding data line for controlling connection and disconnection between the second detection line CTD-ODD-J and the corresponding data line. For the fourth switch T4, the sixth switch is provided between the first detection lines CTD-EVEN-J and the corresponding data line for controlling connection and disconnection between the first detection line CTD-EVEN-J and the corresponding data line.

In one embodiment, as shown in FIG. 3, the fifth switch T5 and the sixth switch T6 are transistors, wherein a control electrode of the fifth switch is connected to the second switching signal line CT-SW-J, and a first electrode of the fifth switch is connected to the second detection line CTD-ODD-J, and a second electrode of the fifth switch is connected to the data line for the pixel units 11. A control electrode of the sixth switch is connected to the second switching signal line CT-SW-J, a first electrode of the sixth transistor is connected to the first detection line CTD-EVEN-J, and a second electrode of the sixth transistor is connected to the data line for the pixel units 12. When detecting the defect connection of the data line, the third switch and the corresponding fifth switch are turned on or off simultaneously to ensure that the second data signal input bus CTD-ODD and the second detection line CTD-ODD-J simultaneously transmit signals to the data lines for odd-numbered columns of pixel units. Moreover, the fourth switch and the corresponding sixth switch are turned on or off simultaneously to ensure that the first data signal input bus CTD-EVEN and the first detection line CTD-EVEN-J simultaneously transmit signals to the data lines for the even-numbered columns of pixel units.

In an embodiment of the present disclosure, as shown in FIG. 3, switching signal control lines SW-R, SW-G and SW-B for sub-pixels are further provided between the data lines and the data signal input buses CTD-EVEN and CTD-ODD, the sub-pixel on each of the data lines connected to the switching signal control lines is a red sub-pixel, a green sub-pixel or a blue sub-pixel, respectively, where SW-R indicates the switching signal control line for the red sub-pixel, SW-G indicates the switching signal control line for the green sub-pixel, and SW-B indicates the switching signal control line for the blue sub-pixel. The first switching device 41 including two switches T3 and T4 is connected between the data signal input buses CTD-EVEN and CTD-ODD and the switching signal control lines for the sub-pixels, as shown in FIG. 3. All of the red, green, and blue sub-pixels on three data lines corresponding to the single switch are taken as a group of pixel units. FIG. 3 shows that all the pixel units 12 on the data line connected to the switching signal control line SW-B in a group of pixel units are blue sub-pixels. For the sake of simplicity, FIG. 3 does not show all the pixel units on the data line connected to the switching signal control line SW-R and all the pixel units on the data line connected to the switching signal control line SW-G in the group of pixel units. Moreover, FIG. 3 shows that all the pixel units 11 on the data line connected to the switching signal control line SW-R in an adjacent group of pixel units are red sub-pixels. For the sake of simplicity, FIG. 3 does not show all the pixel units on the data line connected to the switching signal control line SW-B and all the pixel units on the data line connected to the SW-G in the adjacent group of pixel units. Switches are further provided between the data line and the switching signal control lines SW-R, SW-G and SW-B, and the switches may be thin film transistors.

The detection line is disposed on the other side of the pixel units opposite to the data signal input bus, as shown in FIG. 3.

The data signal input buses are disposed at an upper edge of the array substrate, and the detection lines are disposed at a lower edge of the array substrate, as shown in FIG. 3. It can be understood that it is also possible to dispose the data signal input buses at the lower edge of the array substrate, and dispose the detection lines at the upper edge of the array substrate.

It should be noted that, in this embodiment, description is made by taking only two different signals being provided through data lines for the odd-numbered columns of pixel units and data lines for the even-numbered columns of pixel units as an example. It can be understood that a case where a different signal may be applied every two, three or more columns of pixel units is similar to the case of the present embodiment, and it is only required to provide corresponding detection lines, and specific connection manner is not described herein.

Without departing from the scope of the present disclosure, according to specific application requirements, the present disclosure also includes embodiments in which the detection of defect connection of the data lines may be realized by arranging the data signal input bus and the detection line in the following manner: data signal input bus includes a first data signal input bus CTD-EVEN for even-numbered columns of pixel units and a second data signal input bus CTD-ODD for odd-numbered columns of pixel units, and there is only one detection line CTD-J; alternatively, there is only one data signal input bus CTD, and the detection line includes a first detection line CTD-EVEN-J for even-numbered columns of pixel units and a second detection line CTD-ODD-J for odd-numbered columns of pixel units. In the embodiment in which the data signal input bus and the detection line are arranged in the above manner, compared with the embodiments described above with reference to FIGS. 2 and 3, the difference is only in the number of data signal input buses or detection lines, and other settings and operations are the same. Therefore, for the sake of simplicity, the description will not be made here. A detecting apparatus and a detecting method for detecting defect connection of a data line of an array substrate according to the present disclosure will be described in detail below with reference to the accompanying drawings.

Figure 4:
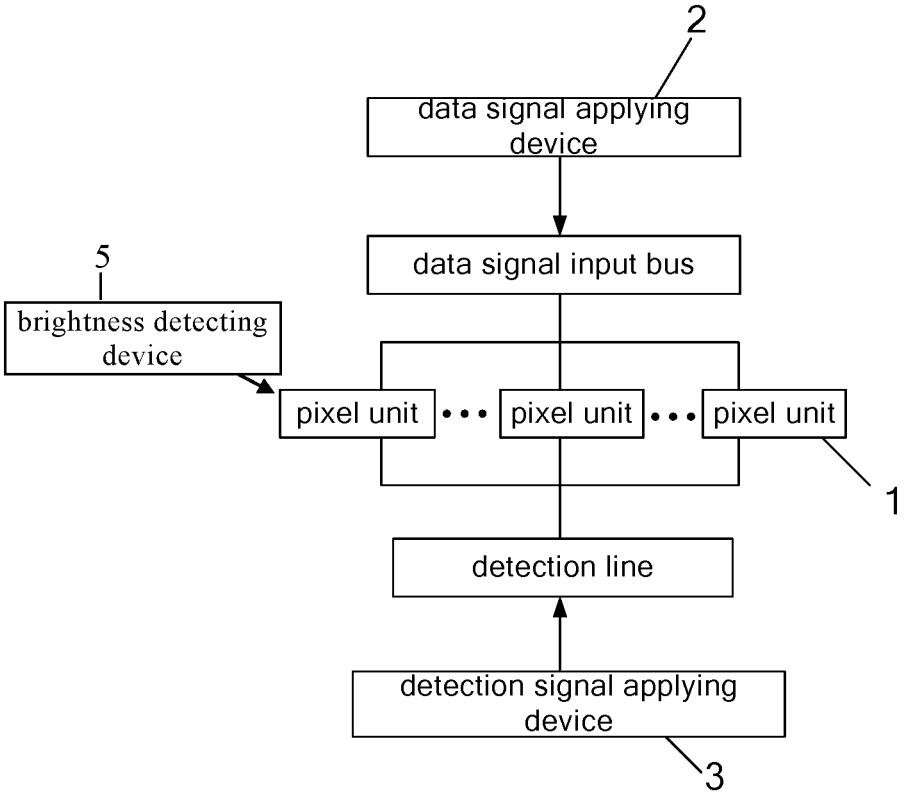
FIG. 4 is a schematic structural diagram of a detecting apparatus for detecting a defect connection of a data line according to an embodiment of the present disclosure.

FIG. 4 is a schematic structural diagram of a detecting apparatus for detecting a defect connection of a data line according to an embodiment of the present disclosure. As shown in FIG. 4, the detecting apparatus is configured to detect defect connection of the data line of the array substrate according to the present disclosure, and the detecting apparatus includes: a data signal applying device 2, a detection signal applying device 3 and a brightness detecting device. The data signal applying device 2 applies a data signal to data lines through the data signal input bus, and at the same time, the detection signal applying device 3 applies a detection signal to the data lines through the detection line, the detection signal and the data signal are applied simultaneously and have contrary polarities. The brightness detecting device is configured to detect whether the pixel unit 1 is lit when detecting whether or not a defect connection exists in any of the data lines of the array substrate of the present disclosure to determine whether or not the defect connection exists in the data line corresponding to the pixel unit 1.

Further referring to the case where some data lines are normal and one data line has defect connection as shown in FIG. 1. An object of the present disclosure is to detect whether a defect connection exists in any of the data lines.

Specifically, a position of the data line existing defect connection is equivalent to a position with high resistance. Therefore, according to Joule's law: Joule heat $Q=I^2RT$, the larger the resistance is, the larger the heat will be generated. Therefore, when the detection is performed, a disconnection occurs at the position of the data line existing defect connection, thereby the defect connection can be effectively detected, which is quick and convenient. In one embodiment of the present disclosure, the data signal input bus and detection line typically provide a voltage between about 5V and about 10V.

More specifically, the brightness detecting device, in particular brightness detecting device 5 of FIG. 4, may be a brightness meter, or the brightness detection may be manually performed. Since the polarity of the detection signal is contrary to the polarity of the data signal in this embodiment, that is, if the data line has a defect connection therein, a disconnection will occur, and the pixel unit at the position of the data line existing defect connection is not lit. Therefore, manual detection is intuitive and convenient.

Figure 5:
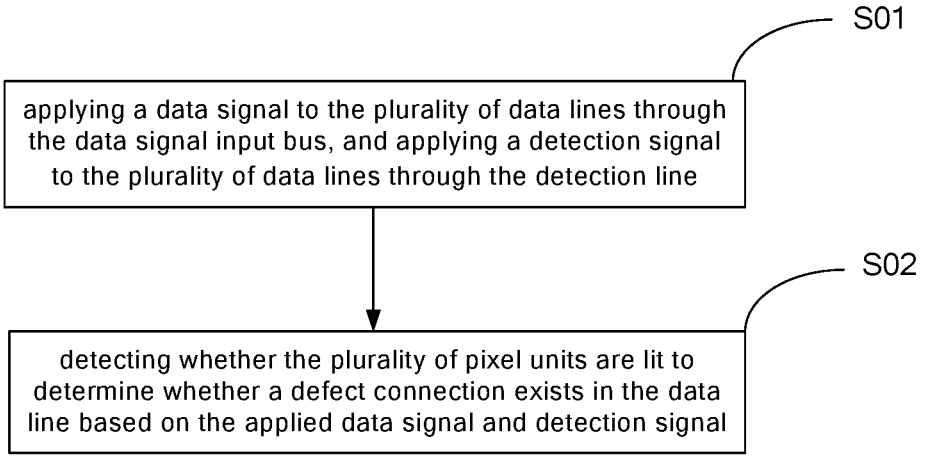
FIG. 5 is a flow chart of a detecting method for detecting a defect connection of a data line according to an embodiment of the present disclosure.

FIG. 5 is a flow chart of a detecting method for detecting a defect connection of a data line according to an embodiment of the present disclosure. As shown in FIG. 5, at step S01, applying, by the data signal applying device, a data signal to the data lines through the data signal input bus, and at the same time, applying, by the detection signal applying device, a detection signal to the data lines through the detection line, the detection signal and the data signal have contrary polarities and are applied at the same time. At step S02, detecting whether pixel units connected to the data lines are lit to determine whether a defect connection exists in the data lines.

The above method is suitable for detecting an array substrate according to an embodiment of the present disclosure. The method can quickly detect all data lines and accurately detect and determine the defect connection in the data lines, the detection process is simple, convenient and fast. Many variations of the above embodiments may be made without departing from the scope of the present disclosure. Specifically, specific connection manner in the pixel unit is not limited to the form disclosed in the embodiment of the present disclosure, and may be varied according to display requirements. Specific setting of the detection signal applying device is also not limited to the form disclosed in the embodiment of the present disclosure, and can be selected according to actual conditions.

An embodiment of the present disclosure also provides a display device including any of the array substrates disclosed in the above embodiments of the present disclosure. The display device may be any product or component having a display function, such as a liquid crystal display panel, an electronic paper, an OLED panel, a mobile phone, a tablet computer, a television, a display, a notebook computer, a digital photo frame, a navigator, and the like.

The embodiments of the present disclosure are described herein for explaining principles of solutions of the present disclosure and are exemplary, the present disclosure is not limited thereto. For those skilled persons in the art, various modifications and variants may be made without departing from the scope of the present disclosure, such modifications and variants also fall into the scope of the present disclosure.

The invention claimed is:

1. A detecting apparatus for detecting defect connection of a data line of an array substrate, comprising:

the array substrate, comprising:

a plurality of gate lines;

a plurality of data lines intersected with the plurality of gate lines; and a plurality of pixel units defined by the gate lines and the data lines;

a data signal input bus connected to one end of each of the plurality of data lines;

a detection line connected to the other end of each of the plurality of data lines;

a data signal applying device coupled to the data signal input bus and configured to apply a data signal to the plurality of data lines through the data signal input bus;

a detection signal applying device coupled to the detection line and configured to apply a detection signal to the plurality of data lines through the detection line; and a brightness detecting device configured to detect whether the plurality of pixel units are lit to determine whether a defect connection exists in the plurality of data lines, wherein a polarity of the data signal transmitted through the data signal input bus is contrary to that of the detection signal transmitted through the detection line, and the data signal transmitted through the data signal input bus and the detection signal transmitted through the detection line are applied simultaneously.

2. The detecting apparatus according to claim 1, wherein the data signal input bus is disposed at one side of the plurality of pixel units, and the detection line is disposed at another side of the plurality of pixel units opposite to the data signal input bus.

3. The detecting apparatus according to claim 1, wherein the array substrate further comprises at least one first switching device, a first terminal of each of the at least one first switching device is coupled to the data signal input bus, a second terminal of each of the at least one first switching device is coupled to a corresponding one of the plurality of data lines, the at least one first switching device is configured for controlling connection and disconnection between the data signal input bus and the plurality of data lines under control of a control terminal of the at least one first switching device.

4. The detecting apparatus according to claim 3, wherein the array substrate further comprises at least one second switching device, a first terminal of each of the at least one second switching device is coupled to the detection line, a second terminal of each of the at least one second switching device is coupled to a corresponding data line of the plurality of data lines, and the at least one second switching device is configured for controlling connection and disconnection between the detection line and the plurality of data lines under control of a control terminal of the at least one second switching device.

5. The detecting apparatus according to claim 1, wherein the plurality of pixel units comprise even-numbered columns of pixel units and odd-numbered columns of pixel units, and the data signal input bus comprises a first data signal input bus and a second data signal input bus, the first data signal input bus is connected to data lines for the even-numbered columns of pixel units, and the second data signal input bus is connected to data lines for the odd-numbered columns of pixel units.

6. The detecting apparatus according to claim 5, wherein the array substrate further comprises a first switching device provided between the data signal input bus and the data lines and configured for controlling connection and disconnection between the data signal input bus and the data lines, wherein the first switching device comprises at least one third switch provided between the second data signal input bus and the data lines for the odd-numbered columns of pixel units and configured for controlling connection and disconnection between the second data signal input bus and the data lines for the odd-numbered columns of pixel units, and at least one fourth switch provided between the first data signal input bus and the data lines for the even-numbered columns of pixel units and configured for controlling connection and disconnection between the first data signal input bus and the data lines for the even-numbered columns of pixel units.

7. The detecting apparatus according to claim 6, wherein the array substrate further comprises a second switching device, wherein the second switching device comprises at least one fifth switch and at least one sixth switch, a first terminal of the fifth switch is coupled to a second detection line, a second terminal of the fifth switch is coupled to the data lines for the odd-numbered columns of pixel units, and the fifth switch is configured for controlling connection and disconnection between the second detection line and the data lines for the odd-numbered columns of pixel units under control of a control terminal of the fifth switch; a first terminal of the sixth switch is coupled to a first detection line, a second terminal of the sixth switch is coupled to the data lines for the even-numbered columns of pixel units, and the sixth switch is configured for controlling connection and disconnection between the first detection line and the data lines for the even-numbered columns of pixel units under control of a control terminal of the sixth switch.

8. The detecting apparatus according to claim 7, wherein the data lines for the odd-numbered columns of pixel units are respectively connected to the third switch and the fifth switch, and the data lines for the even-numbered columns of pixel units are respectively connected to the fourth switch and the sixth switch.

9. The detecting apparatus according to claim 8, wherein the third switch and the fifth switch are turned on or off simultaneously.

10. The detecting apparatus according to claim 8, wherein the fourth switch and the sixth switch are turned on or off simultaneously.

11. The detecting apparatus according to claim 1, wherein the plurality of pixel units comprise even-numbered columns of pixel units and odd-numbered columns of pixel units, and the detection line comprises a first detection line and a second detection line, the first detection line is connected to data lines for the even-numbered columns of pixel units, the second detection line is connected to data lines for the odd-numbered columns of pixel units.

12. The detecting apparatus according to claim 1, wherein the detection signal and the data signal are voltage signals ranging from 5V to 10V.

13. A method for detecting defect connection of a data line of the array substrate using the detecting apparatus according to claim 1.

14. The method according to claim 13, wherein the detection signal and the data signal are voltage signals ranging from 5V to 10V.

15. A display device, comprising the detecting apparatus and array substrate according to claim 1.

* * * * *